US006152435A

United States Patent [19]

Snell

[11] Patent Number: 6,152,435

[45] Date of Patent: Nov. 28, 2000

[54] MULTI-DIAMETER VISE CLAMP AND COLLET JAW

[75] Inventor: Lloyd D. Snell, 2017 Stevenson, Ames, Iowa 50010

[73] Assignees: Lloyd D. Snell; Mark Bly; Joseph Green; Jeff Vanik; D. J. Opdahl

[21] Appl. No.: 09/127,232

[22] Filed: Jul. 31, 1998

[51] Int. Cl.[7] ..... B25B 1/20

[52] U.S. Cl. ..... 269/43; 269/268; 269/282; 269/283

[58] Field of Search ..... 269/45, 43, 268–270, 269/282, 283, 284, 279, 274, 285, 286; 279/137, 152, 153

[56] References Cited

U.S. PATENT DOCUMENTS

| | | | |
|---|---|---|---|
| 569,057 | 10/1896 | Reilly . | |
| 713,189 | 11/1902 | Yates | 269/283 |
| 893,875 | 7/1908 | Schneider . | |
| 1,336,610 | 4/1920 | Borchers . | |
| 1,397,409 | 11/1921 | Duwelius . | |
| 1,550,751 | 8/1925 | Sinkler | 269/283 |
| 1,672,808 | 6/1928 | Hansel . | |
| 2,242,080 | 5/1941 | Kurzina | 269/270 |
| 2,284,449 | 5/1942 | Rodess | 269/283 |
| 2,520,435 | 8/1950 | Roman . | |
| 2,520,448 | 8/1950 | Abegg . | |
| 2,552,618 | 5/1951 | Boatright . | |
| 2,666,352 | 1/1954 | Philips . | |
| 2,770,156 | 11/1956 | Bettrager | 269/283 |
| 2,938,414 | 5/1960 | Blomme . | |
| 2,948,172 | 8/1960 | Sloboda et al. | 269/283 |
| 2,962,919 | 12/1960 | Grundmann et al. . | |
| 3,403,901 | 10/1968 | Servadio | 269/284 |
| 3,947,048 | 3/1976 | Hubbell . | |
| 4,251,066 | 2/1981 | Bowling | 269/283 |
| 4,422,629 | 12/1983 | Carlson | 269/283 |
| 4,575,061 | 3/1986 | Dille | 269/45 |
| 4,706,949 | 11/1987 | Dossey et al. | 269/283 |
| 4,711,439 | 12/1987 | Campbell . | |
| 4,852,866 | 8/1989 | Kristoff . | |
| 4,854,568 | 8/1989 | Baeza et al. . | |
| 4,973,823 | 11/1990 | Benway et al. . | |
| 5,054,974 | 10/1991 | Wellach . | |

*Primary Examiner*—Robert C. Watson
*Attorney, Agent, or Firm*—James M. Ritchey

[57] ABSTRACT

A machine vise has incorporated into it a pair of collet jaws that allows for the machining of top surfaces and ends of a held part. The collet jaws are secured to each of the clamping blocks on the machine vise. The collet jaws include at least one collet pocket shaped into the inside surface of each collet jaw. The collet pockets are designed to receive collet pads which are shaped to hold a generally cylindrical part with varying diameters. By having more than one collet pocket within each collet jaw, several different sizes of collet pads can be utilized at the same time and a part with varying diameters can be held securely in place within the machine vise.

16 Claims, 6 Drawing Sheets

MULTI-DIAMETER VISE CLAMP AND COLLET JAW

BACKGROUND OF THE INVENTION

1. Field of the Invention

A machine vise clamp comprising a set or sets of collet jaws and a plurality of collet pads is disclosed. More specifically, the collet jaws and collet pads are utilized to facilitate mounting and machining both cylindrical and complex non-cylindrical parts with multiple diameters and a common axis (thus, a uniform axial position is maintained).

2. Description of the Background Art

Related in U.S. Pat. No. 569,057 is a clamping jaw for a vise that allows for two direction clamping. The jaws of each clamp have graduated grooves or corrugations in their faces at angles to each other. These grooves are shaped so that a pipe is clenched or clamped by and between the points of intersection of the grooves and flat portions of the jaws.

U.S. Pat. No. 893,875 teaches a clamping devise where an object, particularly of irregular shape, may be quickly and firmly secured in position to be worked upon by a machine tool. The clamping device has several indentations designed to secure various diameter round articles.

U.S. Pat. No. 1,336,610 similarly teaches a clamping devise with variously sized and shaped indentations designed to secure various diameter rounded articles between two jaws.

An equalizing attachment for vise jaws is presented in U.S. Pat. No. 1.397,409. Pivoting and notched elements adapt to distribute applied pressure to unusually shaped objects placed within the vise jaws.

U.S. Pat. No. 1,672,808 presents collet assemblies with inserts for round contours. The clamp jaw is formed with a V-shaped notch which is lined with a soft substance to prevent damage to the object being held secure.

Disclosed in U.S. Pat. No. 2,520,435 is a resilient faceplate for recessed vise jaws. A vertically grooved face is utilized in holding cylindrical rods or tubes of approximately the same diameter while being worked on by a milling or similar devise.

U.S. Pat. No. 2,520,448 presents an oil well gripping element. Within a housing are held gripping elements that are used to apply pressure to a cylindrical object.

Described in U.S. Pat. No. 2,552,618 is a pipe slip insert for improved holding of drilling tool strings incident to the lowering or raising of such strings into or out or a well casing. The curved inner faces of a drill pipe slip body assembly are fitted with means to aid in holding an associated drill pipe.

U.S. Pat. No. 2,666,352 furnishes a resilient vise jay faceplate having a magnetic insert of lesser thickness. Variously shaped magnetic inserts are placed within a holding faceplate to secure any magnetic parts in the item to be clamped.

A screw vise is supplied in U.S. Pat. No. 2,938,414. The clamp jaw has a soft lining hingedly secured to lugs on the jaws which are movable into position when clamping an object.

Divulged in U.S. Pat. No. 2,962,919 is a gripping die for pipe wrenches and similar devices. Several insert gripping elements or dies are installed into the faces of the gripping components of wrenches.

U.S. Pat. No. 3,947,048 exhibits a segmented circumferentially split collet pad with replaceable serrations. Serrations or teeth are formed into the inner surfaces of interchangeable liner pads for collet jaws to aid in generating a gripping friction between the jaw and the held object.

A system of adapting a pair of traditional steel vise jaws for work which requires resilient gripping of workpieces having delicate surfaces is disclosed in U.S. Pat. No. 4,711,439. The jaw inserts are formed of a resilient material such as polyethylene.

U.S. Pat. No. 4,852,866 teaches a vise adapter for performing work on threaded objects. The adapter has a pair of opposing blocks, the faces of which have mating threaded essentially semi-cylindrical channels which form threaded openings when the faces of the blocks are contiguous. A threaded object is placed in a channel of matching diameter and thread pitch when work is to be performed on the object.

A V-block work holding fixture is disclosed in U.S. Pat. No. 4,854,568. The V-block fixture enables machine operations to be performed on cylindrical work pieces at a variety of predetermined angles.

A collet assembly for cylindrical workpieces is supplied in U.S. Pat. No. 4,973,823. The clamping devise is designed to hold cylindrical workpieces having a nominal radius R which may vary throughout the workpiece tolerance range. The clamping surface is comprised of individual surface portions mounted for independent flexing movement to allow the collet to further compensate for workpiece tolerance variations.

Disclosed in U.S. Pat. No. 5,054,974 is a tool holding device. A threaded cutting tool is held with means that produces length compensation under tension and compression.

The devises summarized above do not provide the ability to securely hold cylindrical parts with multiple diameters. Generally, the prior art described only provides the ability to machine objects which have a relatively uniform cross section. Additionally, the prior art does not allow for easy set-up and quick adaptability to different processes. The foregoing devises also do not adequately reduce or eliminate damage to the workpiece while being secured in place and do not provide precision and accuracy when repeatedly creating multiple pieces. Finally, the safety of the above devices is questionable while an object is being machined.

The foregoing patents reflect the state of the art of which the applicant is aware and are tendered with the view toward discharging applicant's acknowledged duty of candor in disclosing information which may be pertinent in the examination of this application. It is respectfully submitted, however, that none of these patents teach or render obvious, singly or when considered in combination, applicant's claimed invention.

SUMMARY OF THE INVENTION

Many advantages over the prior art and objects for the present invention exist as listed immediately below:

1. The subject invention fits in commonly used and readily available machine vises found in most machine shops.
2. The subject invention provides the ability to securely, accurately and safely hold a multi-diameter cylindrical part in place.
3. The subject invention leaves the ends and top of the cylindrical part exposed and accessible for machining operation (see below in FIG. 5. For details).
4. The subject invention allows the application of higher clamping pressures without causing damage and/or minimizing distortion to the object being secured.

5. The subject invention is of low cost to produce.
6. The subject invention is easy to work with and can be adapted quickly to different diameter parts or differently shaped objects.
7. The subject invention provides the ability to clamp objects that do not have a completely regular cylindrical shape.
8. The subject invention allows increased accuracy within specified tolerances.
9. The subject invention provides the ability to repeatedly create identical parts within specified tolerances.
10. The subject invention is safe to use Disclosed is a machine vise that comprises a base with an integrated tightening mechanism and two or more clamping blocks positioned opposite and parallel to each other. Each of the clamping blocks has an inside and an outside surface. The first clamping block is secured directly to the base of the machine vise while the second clamping block is usually secured to the integrated tightening mechanism, although equivalent configurations are deemed to be within the realm of this disclosure. When the tightening mechanism is being activated (activation may be by turning a screw mechanism, applying suitable hydraulics, or equivalent means), the first clamping block is moved toward the second clamping block and subsequently applies pressure to an object that is placed between the two clamping blocks. Although the preferred embodiment comprises one base affixed clamping block and one moving clamping block (clearly, multiple sets of these may be utilized for larger cylindrical parts), another embodiment comprises having a central fixed clamping block from which two or more movable clamping blocks displace away from each side of the fixed clamping block so that objects may be secured to each side of the fixed clamping block by applying pressure with the movable clamping blocks (also, clearly, multiple sets of these may be utilized for larger cylindrical parts).

The machine vise also is comprised of two or more collet jaws secured to the clamping blocks. Each of the collet jaws has an inside and an outside surface, with the outside surface of each collet jaw being reversibly secured to the inside surface of the clamping blocks. Each collet jaw includes at least one collet pocket formed on the inside surface of each collet jaw. The collet pockets are shaped so as to receive a collet pad within them. The radius of the collet pockets and the outside radius of the collet pads are identical so that an accurate fit between the two is achieved. The collet jaws additionally include means for securing the collet jaws to the clamping blocks.

The collet jaw typically includes one vertically positioned collet pocket located in between two horizontally positioned collet pockets. However, other combinations of collet pockets are possible and are considered within the knowledge of one skilled in the art.

The collet jaws are typically secured to the clamping blocks with screws which are inserted through recessed apertures disposed perpendicular to the outside surface of the collet jaw.

While the present invention contemplates holding multi-diameter cylindrical objects, the collet pads can also be of a shape to hold non-cylindrical objects (i.e., the collet pads are usually radial in configuration for holding cylindrical objects, however, the collet pads may be of any desired general shape from radial, to hexagonal, to any other particular configuration needed to properly match the held object). In addition to standard hardened collet pads, the collet pads can also be made of a blank, non-heat treated, annealed material (herein referred to subsequently as soft jaws) or other soft material that can conform to the shape of the object being held and will reduce the risk of damaging sensitive objects being held within the machine vise. A shim can be incorporated within the collet jaws to facilitate machining the vertical or horizontal collet pockets to set proper positions of the soft jaws.

Also disclosed is a pair of collet jaws for mounting within a standard machine vise as commonly produced by companies such as Kurt®, Chick®, Buck® and Wilton®. The collet jaws are attached to the clamping blocks of these vises to enable the machine vise to hold a multi-diameter cylindrical object.

Other objects, advantages, and novel features of the present invention will become apparent from the detailed description that follows, when considered in conjunction with the associated drawings.

DETAILED DESCRIPTION OF THE PREFERRED EMBODIMENT

With continuing attention to the accompanying drawings, reference will now be made in detail to the preferred embodiments of the invention. While the invention will be described in conjunction with the preferred embodiments, it will be understood that they are not intended to limit the invention to those embodiments. The invention is intended to cover alternatives, modifications and equivalents, which may be included within the spirit and scope of the invention.

Referring now to FIGS. 1–5, there is shown a preferred embodiment of a machine vice for holding securely in place an object which has a non-uniform cross-section. A vise such as this can be utilized in a commercial machine shop or by a layman in a home machine shop setting. By way of example and not by way of limitation, a machine vise such as this can be used to hold a cylindrical shaft which has several varying diameters, and which could not be securely held in place by a conventional machine vise. Alternatively, other objects of non-cylindrical shapes could also be held in place with the present invention as well as objects with a uniform diameter.

Figure 1A:
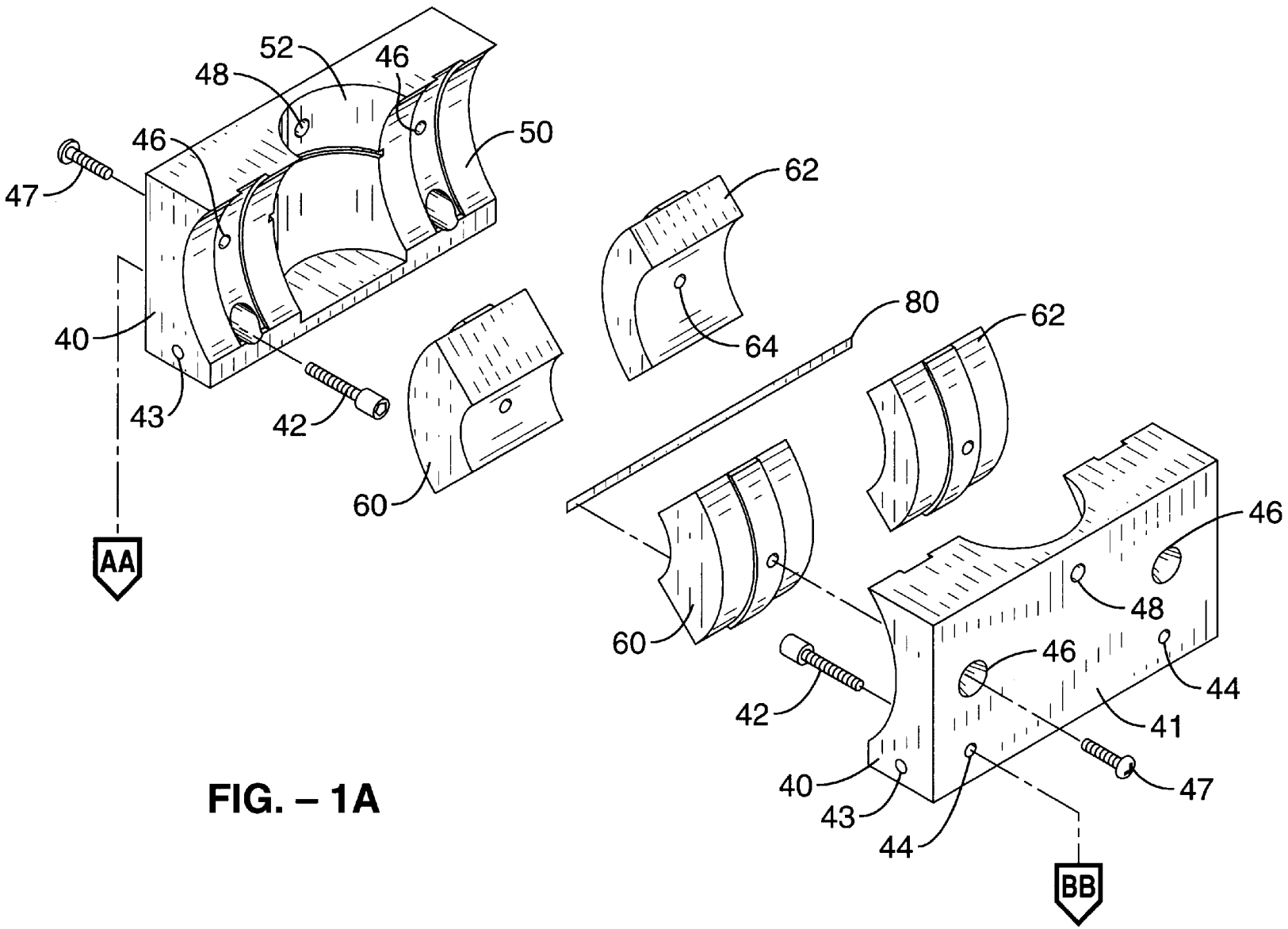
FIG. 1 is an exploded view of the subject invention.
Figure 1B:
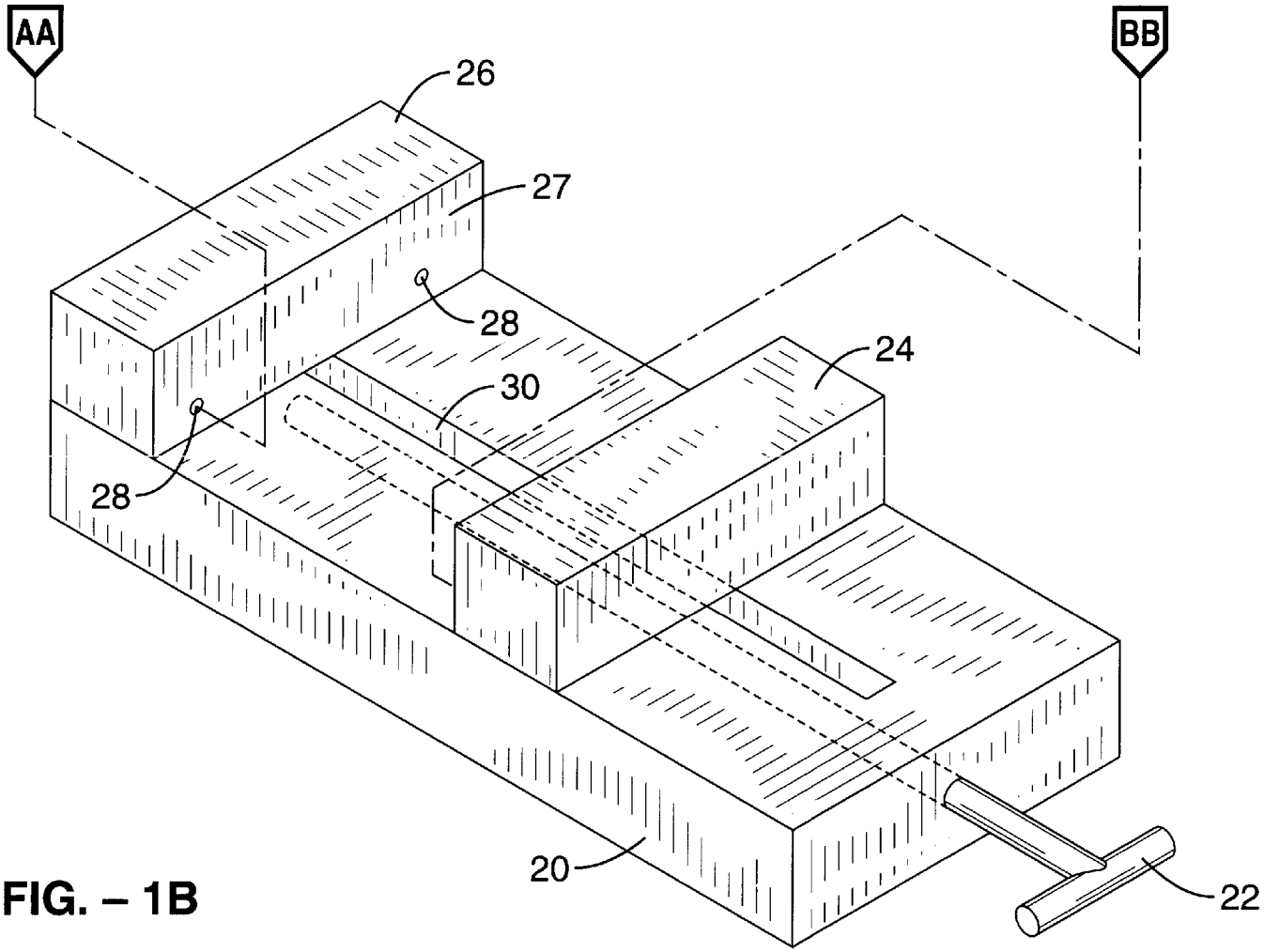

With reference to FIG. 1, an exploded view of the subject invention generally referred to as 10 is shown. The base of a mill vise 20 is shown with opposing parallel clamping blocks 24 and 26. The design of the base 20 and clamping blocks 24 and 26 are of a type commonly found in current mill vise applications and disclosed in the applicable prior art. Clamping block 26 is typically permanently fixed to or forms a part of the base 20, while clamping block 24 is mounted to a slider or screw guide 30 which allows the clamping block 24 to be moved toward or away from clamping block 26. An object which is to be held within the vise (not shown) is secured between the two clamping block 24 and 26 by turning clockwise the vise handle 22 which moves the clamping block 24 toward the clamping block 26 thus applying pressure to the object to be secured in place.

The preferred embodiment of the present invention includes a pair of opposing collet jaws 40 which mount onto each of the clamping blocks 24 and 26. The two collet jaws in the present invention are typically geometrically identical with the outside surface 41 of each being substantially flat so as to fit snugly against the inside surface 27 of the clamping blocks 24 and 26. The inside surfaces of the collet jaws 40 are shaped with one or more collet pockets 50 and 52 to receive one or more pairs of collet pads 60 and 62. The shape of the collet pockets 50 and 52 and the collet pads 60 and 62 will be described in more detail below. Found in the collet jaws are standard threaded work stop apertures 43. Also, the collet jaws have a plurality of apertures 44 located near the perimeter of the collet jaw 40 which allow a cap screw 42 to secure each collet jaw 40 to the respective clamping blocks 24 or 26. The clamping blocks 24 and 26 have threaded apertures 28 to receive the cap screw 42 and secure each collet jaw 40 to the clamping blocks 24 and 26. The cap screws 42 are preferably of the allenhead variety to allow easy and quick assembly and disassembly of the collet jaws from the clamping blocks, however this embodiment is by way of example and not by way of limitation. Other combinations of fastening devices and aperture types can be utilized as well and are considered to be within the scope of one skilled in the art.

The collet jaws 40 are preferably formed of a hardened metallic material which will not deform under the extreme pressure exerted when the vise clamp is engaged.

The collet jaw 40 also includes apertures 46 and 48 located within the collet pockets 50 and 52. The apertures 46 and 48 allow a screw 47 to secure a collet pad 60 or 62 within the collet pockets 50 or 52 of the collet jaw 40. Each collet pad 60 or 62 similarly includes a threaded aperture 64 for the screw 47 to be inserted and secured into. The screw 47 is preferably of the buttonhead variety to allow easy and quick assembly and disassembly of the collet pads 60 and 62 from the collet jaws 40. However this embodiment is by way of example and not by way of limitation. Other combinations of fastening devices and aperture types can be utilized as well and are considered to be within the scope of one skilled in the art.

A shim 80 is provided to allow annealed soft jaws to be inserted in a vertical or horizontal position and machined to a desired pattern or contour. The shim 80 provides the proper spacing to allow for clamping distance after soft jaws have been machined. Typically, after this has been accomplished, the soft collet can be transferred to the vertical or horizontal position, where it would hold the intended part.

Figure 2:
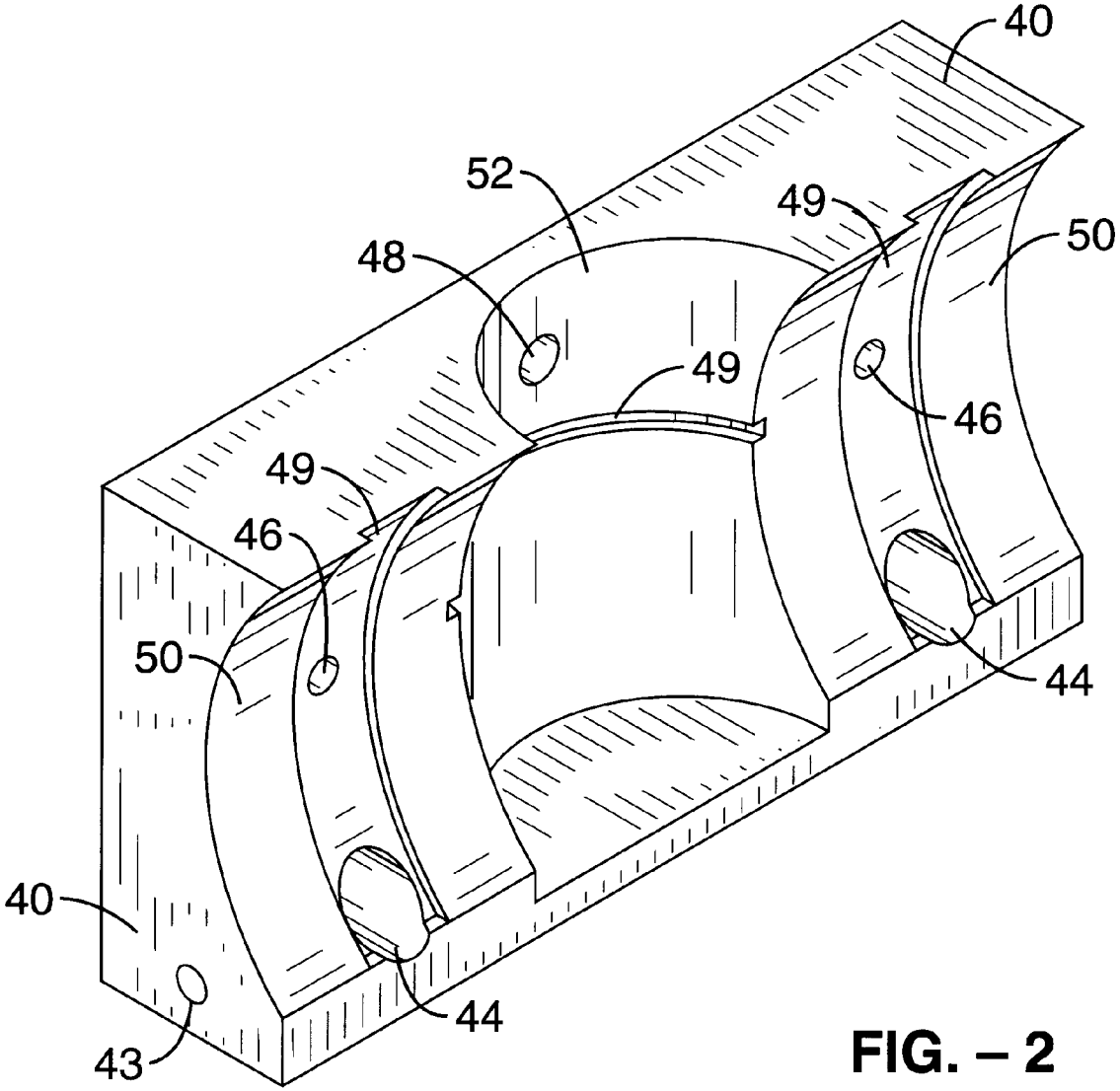
FIG. 2 is a perspective view of the collet jaw of the present invention.

With reference now to FIG. 2, a typical collet jaw 40 of the present invention is shown in more detail. The collet jaw 40 of the present invention includes two horizontal collet pockets 50 located on either side of a vertical collet pocket 52. While the preferred embodiment of the present invention includes two horizontal collet pockets and one vertical collet pocket, this is not meant to limit the invention to this combination of collet pockets but represents the most efficient application for general production efforts. Other combinations of horizontal and vertical pockets are considered within the scope of the present invention and will vary depending on the particular application of the present invention and the particular shape of the workpiece to be secured in place and machined and particularly driven by vise and collet size limitations. By way of example, other combinations of pockets may include two or three horizontal and zero vertical pockets or several vertical pockets and zero horizontal pockets.

The shape of each pocket essentially defines an arc of a circular curve. The center of the curve would be represented by the center of an object being held in the vise clamp of the present invention. The collet jaw 40 includes apertures 44 which allow the collet jaw 40 to be securely but reversibly attached to the clamping blocks 24 and 26 described in FIG. 1. The apertures 44 are recessed below the interior surface of the collet jaw 40 so that when a screw is inserted and tightened, it rests below the inside surface of each collet pocket 50 and does not interfere when a collet pad (not shown) is placed within the horizontal collet pocket 50 or vertical collet pocket 52.

The collet jaw 40 of the present invention additionally includes apertures 46 and 48 which allow a screw to be inserted through the outside surface of the collet jaw and reversibly secure a collet pad (not shown) within each horizontal collet pocket 50 or vertical collet pocket 52. The apertures 46 and 48 are similarly recessed (drilled and countersunk) so that when a screw is inserted, it rests below the outside surface of each collet jaw and does not interfere when the collet jaw 40 is attached to the clamping blocks 24 or 26. The collet jaws 40 additionally include a slot 49 in each collet pocket 50 or 52. The slot 49 provides an added way of securing a collet pad (not shown) into either the horizontal collet pocket 50 or vertical collet pocket 52. The slot 49 provides an initial and quick alignment, in addition to preventing axial movement, of the collet pad within the pocket prior to fastening the collet pad to the collet jaw 40 with a screw and assures that the collet pad is properly aligned before tightly securing it to the collet jaw with a screw or other fastening device.

Figure 3B:
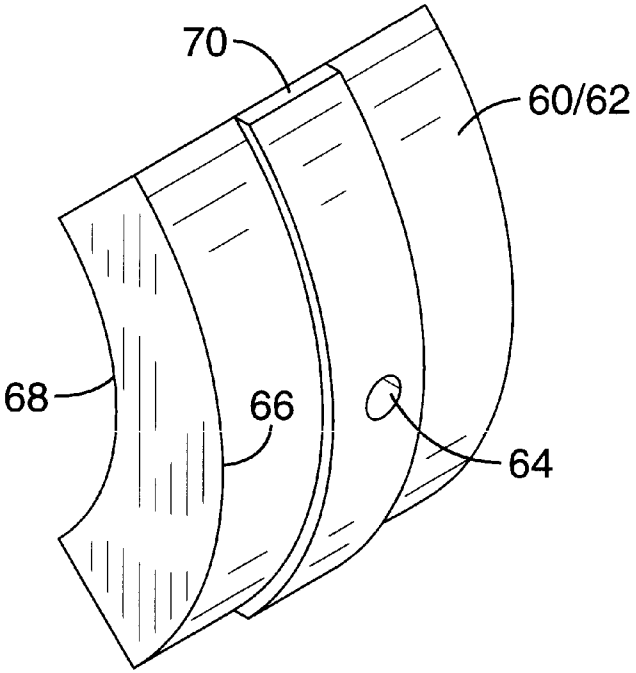
FIGS. 3A and 3B are perspective views of the collet pads of the subject invention.
Figure 3A:
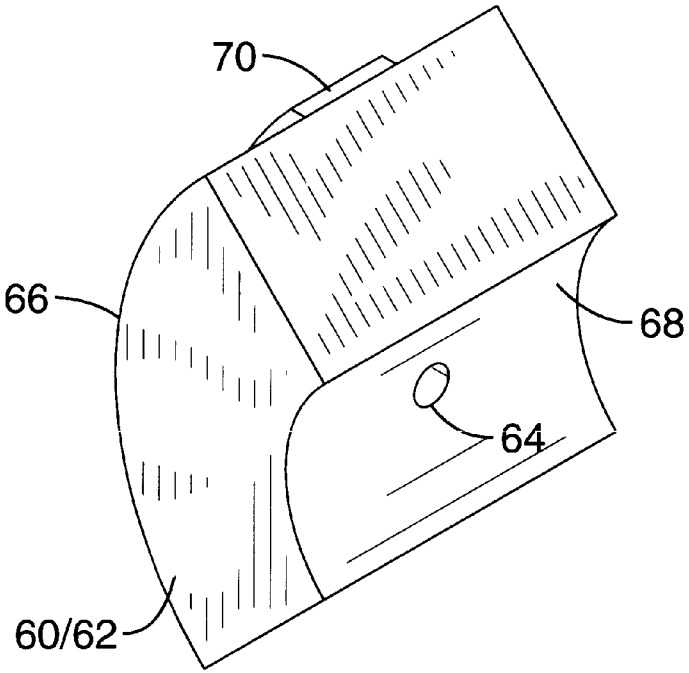

FIGS. 3A and 3B depicts a typical collet pad as utilized in the present invention and is referred to generally as 60 or 62. Collet pads are a standard part in lathe tooling cribs and are used to provide quick, accurate and secure holding of cylindrical parts in many lathe operations. Since collets are already extensively used in machine shops, the present invention is effective at minimizing the costs associated with its operation and maintenance. Since collet pads account for the center of a cylinder, they are ideal for holding multi-diameter shafts or a family of cylindrical parts without reestablishing x, y, and z axial references. The collet pad 60 is generally in the shape of an arc of a hollow tube and includes an outer radius 66 and an inner radius 68. The outer radius 66 corresponds in size and shape to the shape and size of a collet pocket 50 or 52 on the collet jaw 40 previously described. A locking tab 70 is formed onto the outer radius 66 of the collet pad to further secure the collet pad 60 into each collet jaw. The locking tab 70 fits into a slot 49 on the collet jaw 40 described previously in FIG. 2. In the preferred embodiment, the collet pad is made from a hardened metallic material and will resist any deformation when large pressures are applied to it. The collet pads 60 are also preferably formed from a precision ground surface so that the object being machined will be held exactly in place and will not be damaged by the surface of the collet pad. This design will also provide the ability to machine the same part repeatedly with little variance from the part's desired specifications. All collet pads used in the present invention have the same outside radius 66 so that the same collet jaws can be used for many different machining operations and the collet pads are the only items that need to be interchanged.

Figure 4:
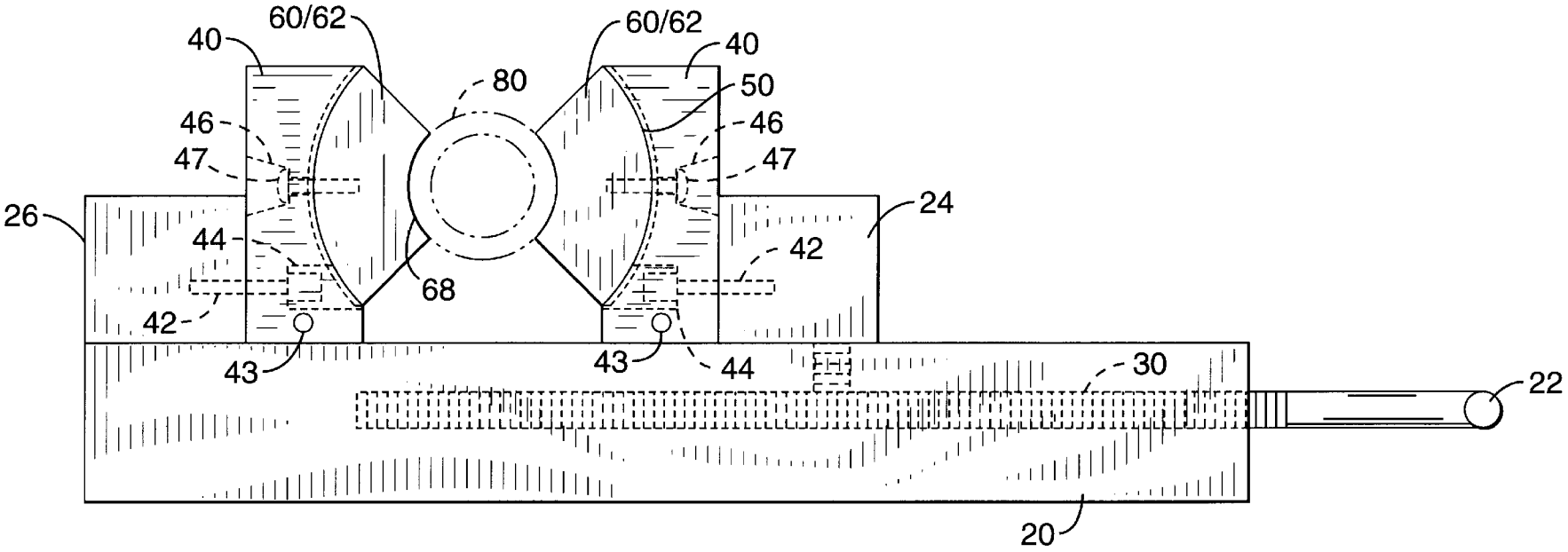
FIG. 4 is a side view of the subject invention.

Referring now to FIG. 4, a cross-section is shown of the present invention while being utilized to secure a cylindrical object into place. The base 20 of a mill vise has opposing clamping blocks 24 and 26. Clamping block 26 is typically fixed into position or forms a part of the base 20 while clamping block 24 is attached to a slide or guide screw 30. When the vise handle 22 is turned, clamping block 24 is moved toward or away from clamping block 26 and either increases or decreases the pressure exerted on the object 80 being secured in place. Collet jaws 40 are attached to the clamping surfaces 24 and 26 and include collet pockets 50 which receive collet pads 60 or 62. The interior surface 68 of the collet pads 60 are shaped to match the radius of the cylindrical object 80 being worked on. Screws 42 are inserted through apertures 44 and secure the collet jaw 40 to the clamping block 24 or 26. Screws 47 are inserted through apertures 46 and secure the collet pads 60 to the collet jaw 40.

The conforming nature of the collet jaws and pads to the radius of the object being worked on allows for high precision and accuracy as well as greatly reducing or eliminating damage to the parts being machined. Compared to pressures applied by current V-jaws described in the prior art, the collet pads provide a much greater contact surface area, thus reducing localized pressure to a part's surface. Since pressure is distributed equally on both sides, the design also eliminates the unbalanced compression forces associated with other prior art vise solutions. In addition to providing for an accurate, non-damaging hold, the firm, balanced grip also increases the safety of the product. Because the collets hold parts so securely, the possibility of parts slipping or dislodging is highly unlikely. Machinists, therefore, have a reduced risk of injury by dislodged or fractured tooling projectiles caused by part slippage.

Figure 5:
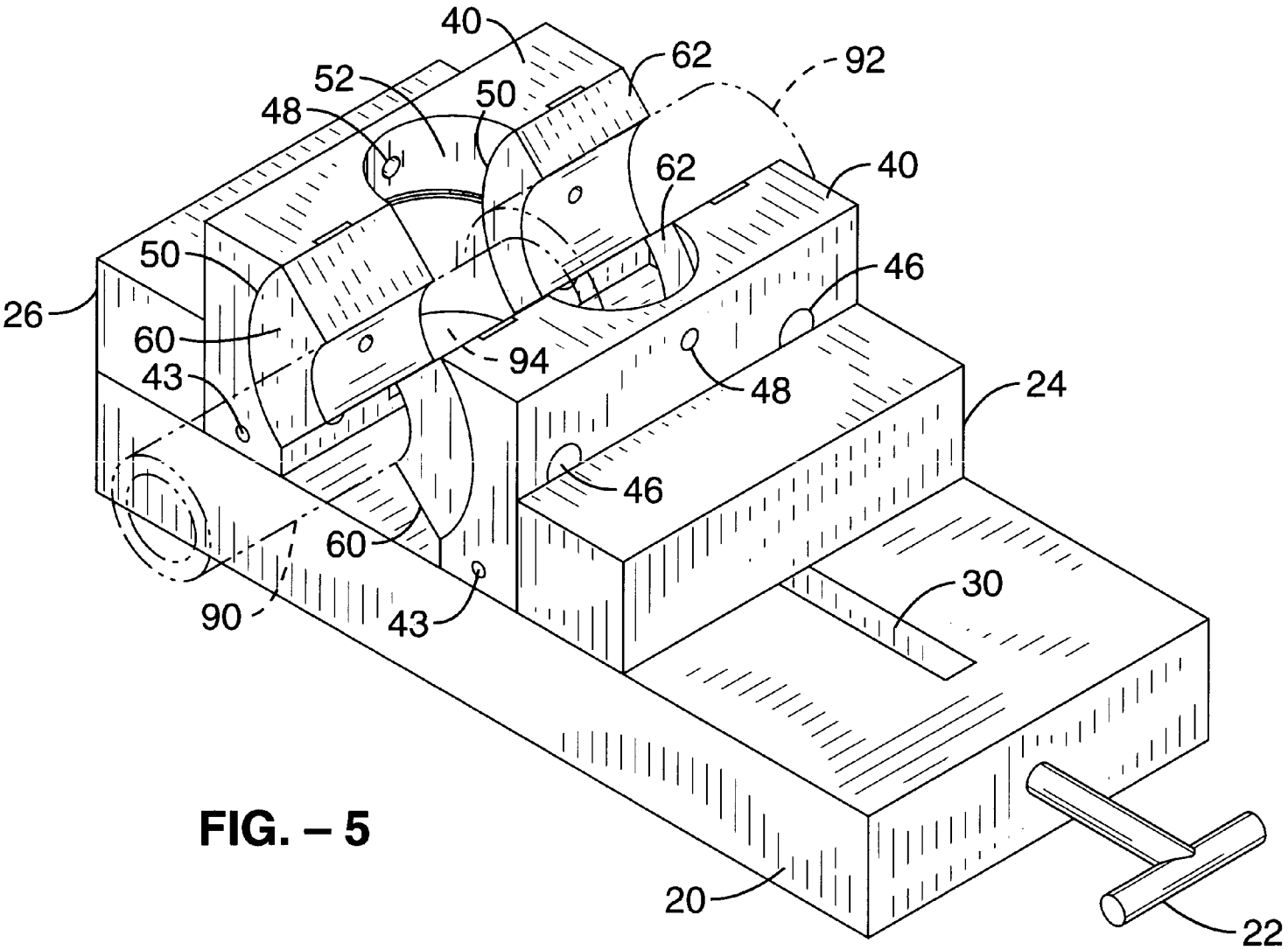
FIG. 5 is a perspective view of a multi-diameter shaft being secured in place within the subject invention.

With attention now to FIG. 5, a perspective view of the present invention is shown while securing a multi-diameter cylindrical shaft 90. The ability to hold cylindrical parts with multiple diameters is a major advantage of the present invention over the prior art. Utilizing several different sized collet pads within several pairs of collet pockets within the same collet jaw allows the varying diameters of a particular shaft to be held equally secure without deflection or misalignment. In FIG. 5, the base of a mill vise 20 has opposing clamping blocks 24 and 26. Each clamping block 24 and 26 has attached to it an identical collet jaw 40 of the present invention. The collet jaws 40 depicted in FIG. 5 include two horizontal pockets 50 and one vertical pocket 52. One set of collet pads 62 are inserted into the horizontal collet pockets 50 which correspond to the larger diameter section 92 of the shaft 90 being machined. The collet pads 62 have an inside radius which matches the radius of the larger section 92 of the shaft 90. Another set of collet pads 60 are inserted into the second set of collet pockets 50 which correspond to the smaller diameter section 94 of the shaft 90. The collet pads 60 have an internal radius which matches the radius of the smaller section 94 of the shaft 90. By providing the ability to interchange differently sized collet pads within the same collet jaw 40, multi-diameter shafts can be held securely, safely and accurately within the vise clamp system. Recessed apertures 46 are also shown which allow a screw to secure the collet pads to the collet jaw. By changing the collet pads used, differently sized objects can be machined. Since all collet pads are sized to fit into the same collet pockets and subsequently the same collet jaws, it is unnecessary to change the collet jaws being used. The same collet jaws can be left in place and used for many different machining operations.

It is also contemplated that the subject invention could be embodied or incorporated into an equivalent interchangeable top block for a vise that has machined-in pads as an integral system in place of the removable pad described in detail above.

The invention has now been explained with reference to specific embodiments. Other embodiments will be suggested to those of ordinary skill in the appropriate art upon review of the present specification.

Although the foregoing invention has been described in some detail by way of illustration and example for purposes of clarity of understanding, it will be obvious that certain changes and modifications may be practiced within the scope of the appended claims.

What is claimed is:

1. A clamping mechanism for holding a multi-diameter part, comprising:

a) a clamping base including:

i) an integrated tightening mechanism and ii) first and second clamping blocks positioned opposite and parallel to each other, said first and second clamping blocks having inside and outside surfaces, said first clamping block being attached to said tightening mechanism and said second clamping block being attached to said base;

b) first and second collet jaws, said first and second collet jaws each having an inside surface and an outside surface, said outside surface of said first collet jaw reversibly secured to said inside surface of said first clamping block and said outside surface of said second collet jaw reversibly secured to said inside surface of said second clamping block, said first and second collet jaws each including:

i) at least a pair of collet pockets formed on said inside surface of each collet jaw, each collet pocket shaped to receive a collet pad and ii) means for securing said collet jaw to said clamping blocks; and c) at least a pair of collet pads reversibly secured to each said collet jaw, a shape of said collet pads essentially forming an arc of a hollow tube, said collet pads having an outside radius and an inside radius, said outside radius being such that said collet pad will accurately fit into said at least one collet pocket, said inside radius being substantially equal to a proximate radius of the part being held in place.

2. A machine vise as in claim 1, wherein said collet jaws include one vertically positioned collet pocket and two horizontally positioned collet pockets, said vertically positioned collet pocket located between said horizontally positioned collet pockets.

3. A machine vise as in claim 1, wherein the means for securing said collet jaw to said clamping blocks includes a plurality of recessed apertures disposed perpendicular to said outside surface of said collet jaw, said apertures designed to receive a fastening device.

4. A machine vise as in claim 1, wherein said collet jaw further includes a means for securing said collet pads to said collet jaws.

5. A machine vise as in claim 4, wherein said means for securing said collet pads to said collet jaws includes a plurality of recessed apertures disposed perpendicular to said outside surface of said collet jaw, said apertures designed to receive a fastening device.

6. A machine vise as in claim 1, wherein said collet pads are made from a hardened metallic material which resists deformation at extreme pressures.

7. A machine vise as in claim 1, wherein said collet pads further include precision ground surfaces to precisely fit the shape of the part being held.

8. A machine vise as in claim 1, wherein said integrated-tightening mechanism is integral and moves said first clamping block toward said second clamping block.

9. A machine vice as in claim 1, wherein the collet jaw further includes a shim that can be positioned between said first and second collet jaws and parallel to said outside surface of each said collet jaw.

10. A machine vice as in claim 1, wherein said at least one collet pocket further includes a recessed slot for more easily receiving said collet pad.

11. A machine vice as in claim 1, wherein said at least one collet pad further includes a raised tab to allow said collet pad to be more easily inserted into said collet pocket.

12. A pair of substantially identical collet jaws for attachment to the clamping block of a machine vise, with each collet jaw designed to receive at least a pair of varying sized and shaped collet pads for securing parts with non-uniform cross sections, each collet jaw having an inside surface and an outside surface and comprising:

a) at least a pair of collet pockets formed on the inside surface of each collet jaw, each said collet pocket shaped to receive a collet pad and b) means for securing the collet jaw to the machine vise clamping block.

13. A pair of collet jaws as in claim 12, wherein said means for securing the collet jaws to the machine vise clamping blocks includes a plurality of recessed apertures disposed perpendicular to the outside surface of the clamping jaw, the apertures designed to receive a fastening device.

14. A pair of collet jaws as in claim 12, wherein each collet jaw includes one vertically positioned collet pocket and two horizontally positioned collet pockets, said vertically positioned collet pocket located between said horizontally positioned collet pockets.

15. A pair of collet jaws as in claim 12, further including a shim that can be positioned between the collet jaws and parallel to the outside surface of each collet jaw.

16. A clamping mechanism for holding a part, comprising:

a) a clamping means including:

i) an integrated tightening mechanism and ii) a plurality of clamping blocks surrounding a central axis, said plurality of clamping blocks having inside and outside surfaces, said plurality of clamping blocks being attached to said integrated tightening mechanism;

b) a plurality of collet jaws with each collet jaw within said plurality of collet jaws having an inside surface and an outside surface, said outside surface of each said collet jaws reversibly secured to said inside surface of one of said clamping blocks and said outside surface of each of said plurality of collet jaws reversibly secured to said inside surface of one of said plurality of clamping blocks, each of said collet jaws each including:

i) at least a pair of collet pockets formed on said inside surface of each of said collet jaws, each collet pocket shaped to receive a collet pad and ii) means for securing each said collet jaw to each of said clamping blocks; and c) at least a pair of collet pads reversibly secured to each of said collet jaws, a shape of each said collet pad essentially forming an arc of a hollow tube, each said collet pad having an outside radius and an inside surface, said outside radius being such that said collet pad will accurately fit into said at least one collet pocket, said inside surface being suitably formed to hold the part being held in place.

* * * * *